US011186473B2

(12) United States Patent
Patrizio

(10) Patent No.: US 11,186,473 B2
(45) Date of Patent: Nov. 30, 2021

(54) CORKSCREW

(71) Applicant: PATRICK S.R.L., Maniago (IT)

(72) Inventor: Cesare Patrizio, Maniago (IT)

( * ) Notice: Subject to any disclaimer, the term of this patent is extended or adjusted under 35 U.S.C. 154(b) by 259 days.

(21) Appl. No.: 16/610,790

(22) PCT Filed: May 9, 2018

(86) PCT No.: PCT/EP2018/000251

§ 371 (c)(1),
(2) Date: Nov. 4, 2019

(87) PCT Pub. No.: WO2018/206149

PCT Pub. Date: Nov. 15, 2018

(65) Prior Publication Data

US 2020/0165113 A1 May 28, 2020

(30) Foreign Application Priority Data

May 10, 2017 (IT) ..... 102017000050698

(51) Int. Cl.
*B67B 7/04* (2006.01)

(52) U.S. Cl.
CPC .... *B67B 7/0429* (2013.01); *B67B 2007/0458* (2013.01)

(58) Field of Classification Search
CPC ..... B67B 7/04–2007/0494
USPC ..... 81/3.55–3.49, 3.36, 3.37
See application file for complete search history.

(56) References Cited

U.S. PATENT DOCUMENTS 6,101,900 A 8/2000 Traspuesto
8,978,518 B2 * 3/2015 Gasman ..... B67B 7/0429 81/3.37

FOREIGN PATENT DOCUMENTS

| | | | | |
|---|---|---|---|---|
| EP | 1151960 A1 | 11/2001 | | |
| ES | 2159472 A1 | 10/2001 | | |
| ES | 2332081 A1 | 1/2010 | | |
| FR | 2689115 A1 | 10/1993 | | |
| FR | 2803839 A1 * | 7/2001 | ..... | B67B 7/0429 |
| WO | 2004074161 A1 | 9/2004 | | |

OTHER PUBLICATIONS

Translation of FR2803839A1, retrieved from Espacenet on Sep. 21, 2021 (Year: 2001).*
International Search Report as to PCT/EP2018/000251.

* cited by examiner

*Primary Examiner* — David B. Thomas
*Assistant Examiner* — Thomas Raymond Rodgers
(74) *Attorney, Agent, or Firm* — Egbert, McDaniel & Swartz, PLLC

(57) ABSTRACT

Corkscrew for the extraction of a cork from the neck of a bottle, wherein the corkscrew has a body, an extraction screw, an articulated lever having a first lever and a second lever, which are coupled with each other by a coupling system with at least one set of slots, a set of pins and a set of holes, which guide the reciprocal movement of the second lever with respect to the first lever.

31 Claims, 11 Drawing Sheets

CORKSCREW

TECHNICAL FIELD

The present invention relates to a corkscrew with a double propping lever according to the characteristics of the pre-characterizing part of claim 1.

PRIOR ART

In the field of the production of corkscrews intended for the extraction of corks or plugs of other materials from the neck of bottles, particularly important are the pocket-sized corkscrews of the foldable type, meaning that the elements of the corkscrew that are used carry out the extraction of the cork can be closed within the volume of the handle or can be pulled close to the handle thus reducing the overall dimensions of the corkscrew when it must be put away.

Corkscrews of the known type are optionally provided with other accessories as well, such as a foldable blade for cutting any possible covering capsule of the end portion of the neck of the bottle or they are optionally provided with an end for opening crown caps.

Corkscrews of this type are known in a wide variety of forms and configurations. Among the known solutions of corkscrews with a double lever, some solutions, such as that described in EP 1 151 960, include two propping levers of which a first lever has a length that is approximately equal to half the length of a second lever, the first and the second lever being hinged at a same pivot point in such a way that the first lever facilitates a more stable propping in a first phase of the extraction in which the cork is completely inserted in the neck of the bottle and in such a way that the second lever, which is longer, facilitates a more stable propping in a second phase of the extraction in which the cork is already partially extracted with respect to the neck of the bottle. The two propping levers are independent of each other and are not constrained to each other, the only point that is common to the two levers is the pivot point which, however, does not constrain the two levers to each other in any way because they are freely rotatable on the pivot point independently of each other. This solution is suitable for the extraction, with the aid of the screw or gimlet spiral, of corks from bottles also when they are partially extracted by the action of the second lever to facilitate the completion of the extraction of the cork.

Other solutions, such as that described in FR2689115, provide that the corkscrew is provided with an articulated lever comprising a first lever that acts as an arm, which is hinged in correspondence of a first end thereof to a handle or grip and which is hinged in correspondence of a second end thereof, opposite to the first end, to a second lever that acts as a forearm. The articulation hinging between the first lever and the second lever occurs by means of one single pin that enables the rotation of the second lever with respect to the first lever. The articulated lever allows to obtain a propping by the first lever in a first phase of the extraction in which the cork is completely inserted in the neck of the bottle and a propping by the second lever in a second phase of the extraction in which the cork is already partially extracted with respect to the neck of the bottle. This solution is suitable for the extraction, with the aid of the screw or gimlet spiral, of corks from bottles also when they are partially extracted by the action of the second lever to facilitate the completion of the extraction of the cork.

Patent application ES 2 332 081 describes a lever corkscrew which is provided with a double articulated lever mechanism consisting of two levers, an internal lever and another longer, external lever, wherein both levers are fixed to the body of the corkscrew in correspondence of respective hinging axes, the levers having grooves through which a pin moves, which connects and joins the levers, each lever being provided with supporting teeth for the bearing of the corkscrew on the neck of the bottle during extraction with bending of the levers around the hinging axes and sliding of the pin. The levers have a "U"-shaped section and the grooves are straight.

U.S. Pat. No. 6,101,900 describes a corkscrew comprising a body, an extraction screw and a lever, wherein the lever has a lever extension element which is slidably nestled inside a recess of the lever itself, the extension element being movable by means of a longitudinal sliding between a first and a second position, the extension element protruding beyond the free end of the lever in the second position and remaining nestled within the lever in the first position.

Patent application WO 2004/074161 describes a lever corkscrew that is particularly suitable for the extraction of long corks, which are considerably resistant particularly in the final phase of extraction. The corkscrew in question comprises a partially hollow handle to which an extraction screw and a propping lever are fixed. The propping lever is connected by means of a first pin to a shaped element hinged in the upper part of the handle. The shaped element is connected to a second pin and is rotated by the lever in the final phase of extraction, sliding the second pin along an arch-shaped slit present in the upper part of the handle, thus extending the extraction stroke.

Patent application ES 2 159 472 describes a corkscrew having an extraction screw, supporting means on the neck of the bottle, and comprising an arm with a toothed portion and a driving mechanism consisting of a handle with a hinged pushing bar that acts on the teeth, the arm being mounted in a movable position in a defined area in the main body, the bar and the screw being mounted in a hinged way on the opposite ends of the body by means of corresponding pins.

PROBLEMS OF THE PRIOR ART

The solutions, such as that described in EP 1 151 960, which provide the presence of two propping levers of which a first lever has a length that is approximately equal to half the length of a second lever and in which both levers are hinged at a same common pivot point have the disadvantage that during each extraction phase, that is to say, the first phase of extraction by means of the first, shorter lever and during the second extraction phase with the second, longer lever, the lever that is not used during the phase in progress constitutes an obstacle to the performance of the extraction phase itself. Furthermore, the presence of this obstacle can result in an unstable propping support with the consequence that, when the user exerts the traction on the handle to exert the corresponding extraction force on the cork, the propping tooth can slide laterally getting out of the condition of engagement on the edge of the neck of the bottle. This occurs due to the fact that during extraction, for a vertical exit of the cork, the pointing lever must necessarily be inclined starting from an initial condition of parallelism with the screw or gimlet spiral. As a consequence, in the long run, such sliding of the propping tooth on the edge of the neck of the bottle can cause an early wear of the propping tooth that will progressively lead to an additional worsening of the functionality of the corkscrew.

Even the solutions like that described in FR2689115, in which the corkscrew is provided with an articulated lever comprising a first lever and second lever that are reciprocally hinged one after the other, have the same drawbacks with the added disadvantage that the second lever, being hinged at one single pivot point on the first lever, shows in an even more marked way the tendency to slide on the edge of the neck of the bottle because the position of the second lever is even more unstable with respect to the previously described solutions.

Many of the prior art solutions are subject to a problem related to the direction according to which the extraction of the cork occurs, which is not a perfectly vertical direction and, therefore, causes a bending of the cork itself during the extraction phase, which may lead to breaking the cork itself with the consequence that the uncorking operation must be interrupted and then started again to extract the broken cork stump that has remained within the neck of the bottle with the additional risk that portions of cork may contaminate the wine or product within the bottle.

Furthermore, in some prior art solutions provided with an articulated lever in which a first lever is used for a first part of the cork extraction process and a second lever, hinged on the first lever, is used for a second part of the cork extraction process, the first lever may remain in a condition of interference with respect to the direction of additional lifting of the cork for the completion of the extraction with the consequence that the cork gets stuck below the first lever, which thus prevents the complete extraction of the cork carried out by using the second lever.

AIM OF THE INVENTION

The aim of the present invention is to provide a corkscrew with a double propping lever, associated with a screw or gimlet spiral for extracting the cork, reducing the risk that the play present between the two levers constituting the double propping lever may involve the loss of the support during the phase of application of the cork extraction force.

A further aim is to increase the versatility of the corkscrew and the reliability of the extraction operation.

CONCEPT OF THE INVENTION

The aim is achieved by the characteristics of the main claim. The dependent claims represent advantageous solutions.

ADVANTAGEOUS EFFECTS OF THE INVENTION

The solution according to the present invention, by the considerable creative contribution the effect of which constitutes an immediate and important technical progress, presents various advantages.

First of all it is prevented that the play present between the two levers constituting the double propping lever may involve the loss of the support during the phase of application of the cork extraction force.

Moreover, although maintaining a cost-effective solution as a whole, the reliability of the extraction operation and the duration of the corkscrew, which is advantageously less subject to wear, are increased.

DESCRIPTION OF THE DRAWINGS

In the following a solution is described with reference to the enclosed drawings, which have to be considered as a non-limiting example of the present invention, in which.

DESCRIPTION OF THE INVENTION

Figure 1:
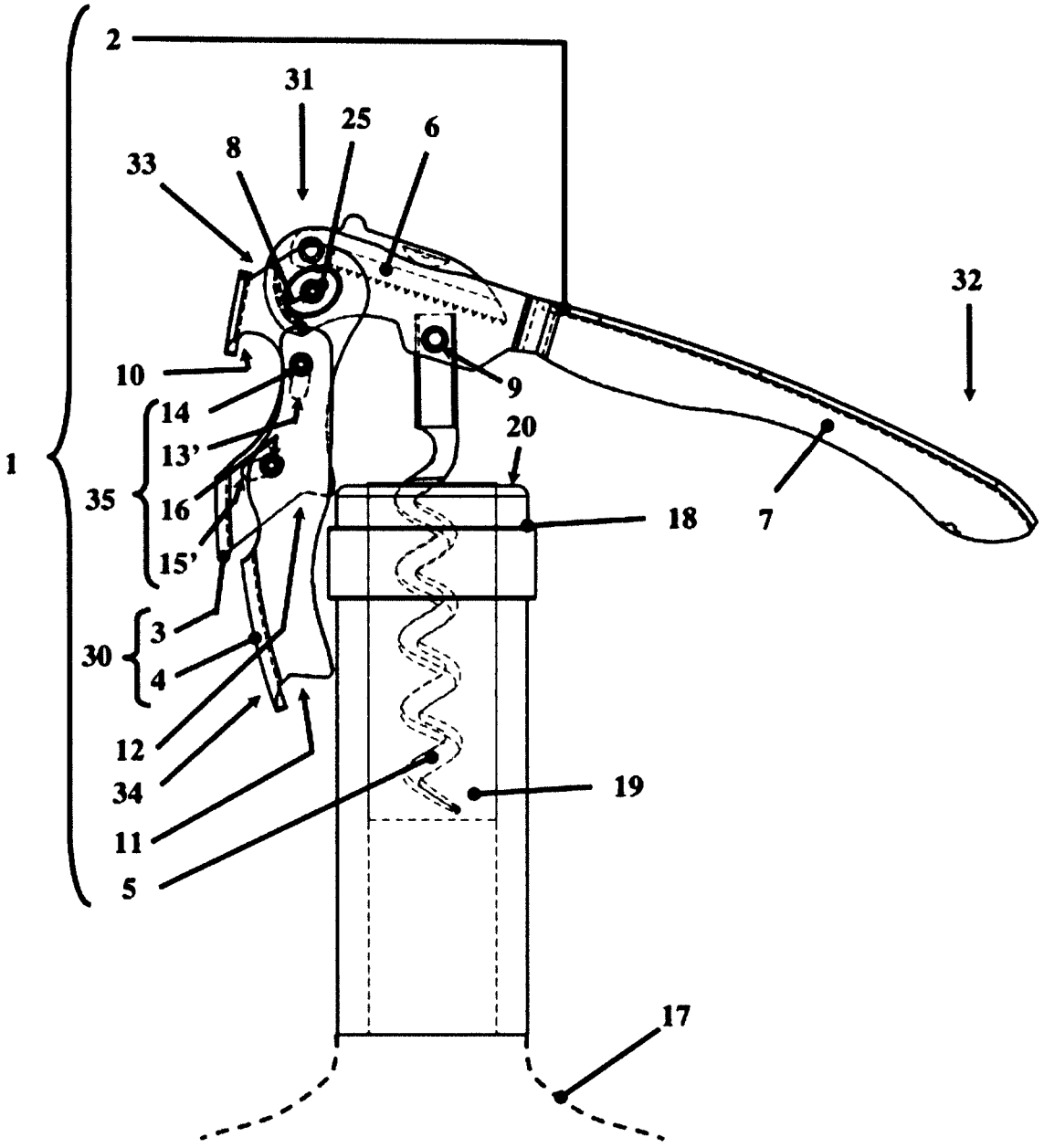
FIG. 1 represents a schematic side view of the corkscrew according to the invention in a first phase of the process of extraction of a cork from the neck of a bottle in which the extraction screw or gimlet spiral has been inserted into the cork to be extracted.

With reference to the figures (FIG. 1, FIG. 8, FIG. 9, FIG. 10, FIG. 11) the corkscrew (1) according to the present invention comprises a body (2) provided with a handle (7). On the body one can optionally apply a blade (6) or analogous or similar cutting means, such as cutting wheels, for the removal of the covering capsule or coating of the neck of the bottle, according to known prior art configurations.

On the body (2), in correspondence of a first end (31) of the body, an articulated lever (30) is applied, which is configured and structured to cooperate with an extraction screw (5) which can be rotated around a pivot point (9) in such a way as to be able to handle the extraction screw (5) between a first extracted working position and a second rest position in which the extraction screw (5) is housed within the volume of the body (2) or pulled close along the longitudinal development of the body (2) in order to reduce the overall dimensions of the corkscrew (1) when it must be put away. The articulated lever (30) consists of a first lever (3) and of a second lever (4).

Figure 7:
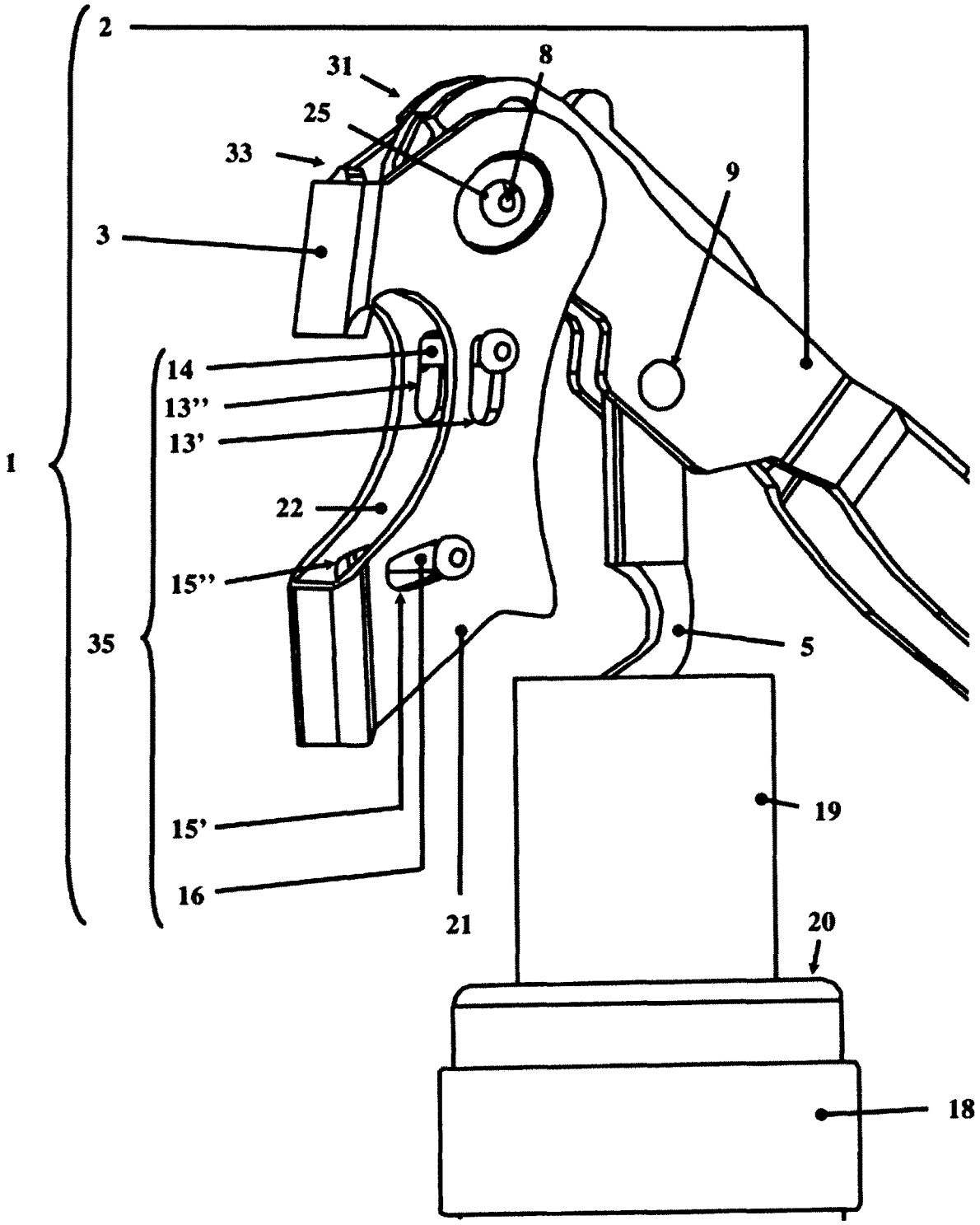
FIG. 7 represents a schematic perspective view of the corkscrew according to the invention in a position corresponding to that of FIG. 5, in which the second lever has been removed to show the details of the first lever of the corkscrew.
Figure 8:
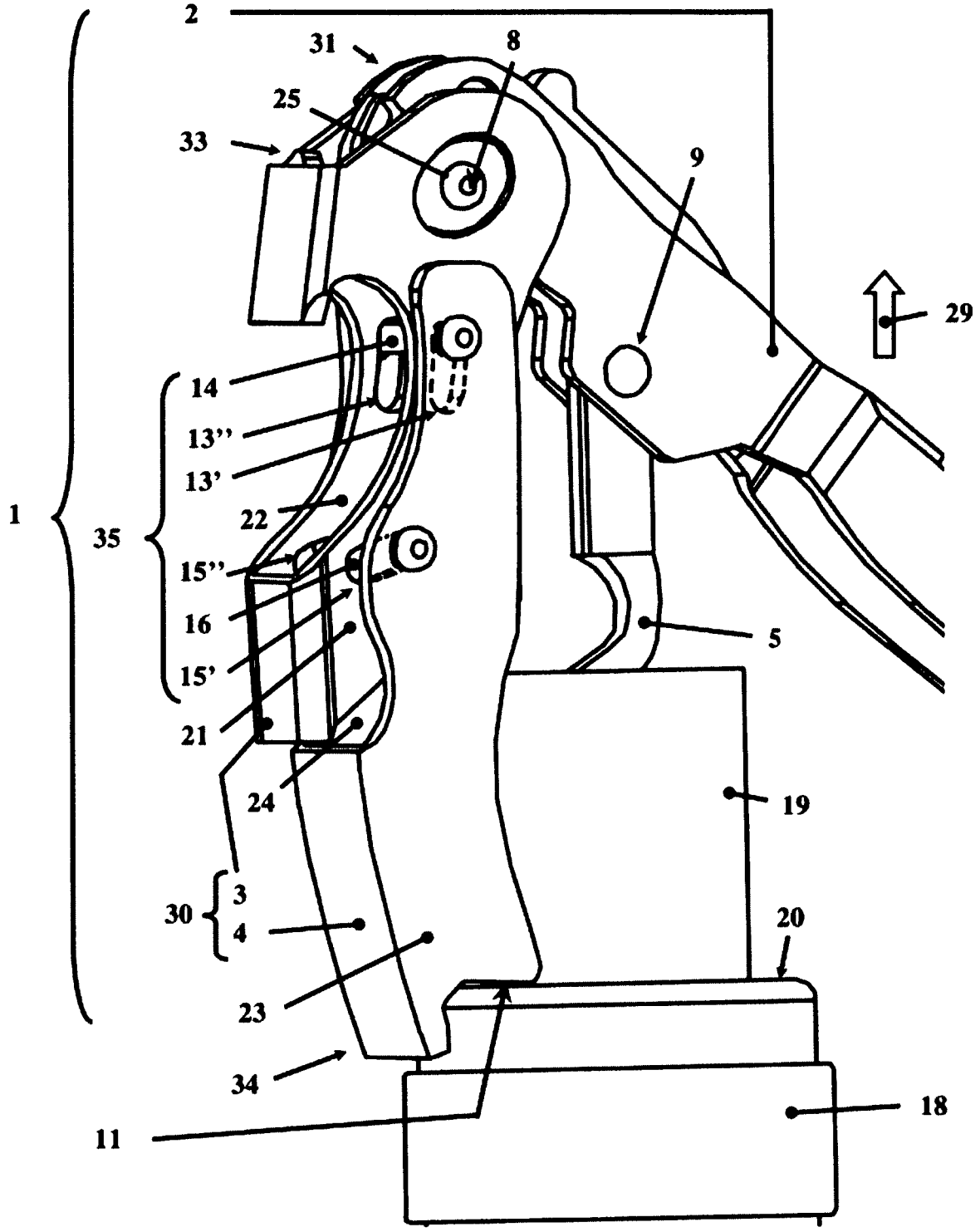
FIG. 8 represents a schematic perspective view of the corkscrew according to the invention in a position corresponding to that of FIG. 7, in which the second lever of the corkscrew is also shown again.
Figure 9:
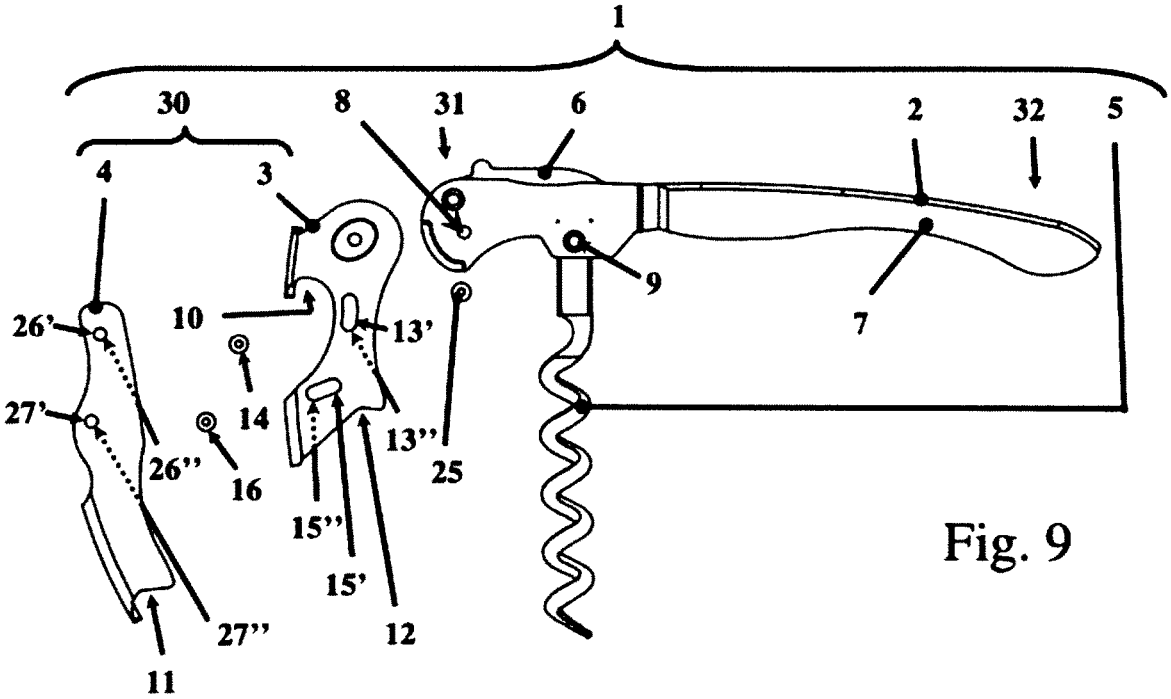
FIG. 9 represents a schematic partially exploded side view of the corkscrew according to the invention.
Figure 10:
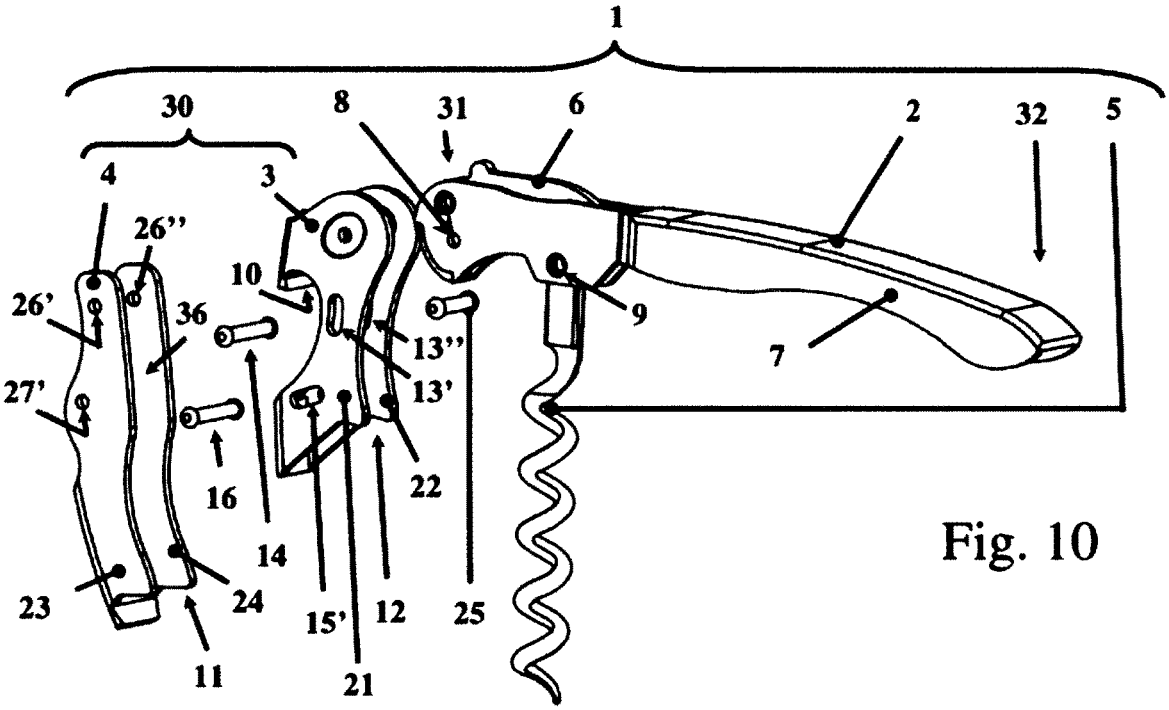
FIG. 10 represents a schematic partially exploded perspective view of the corkscrew according to the invention.
Figure 11:
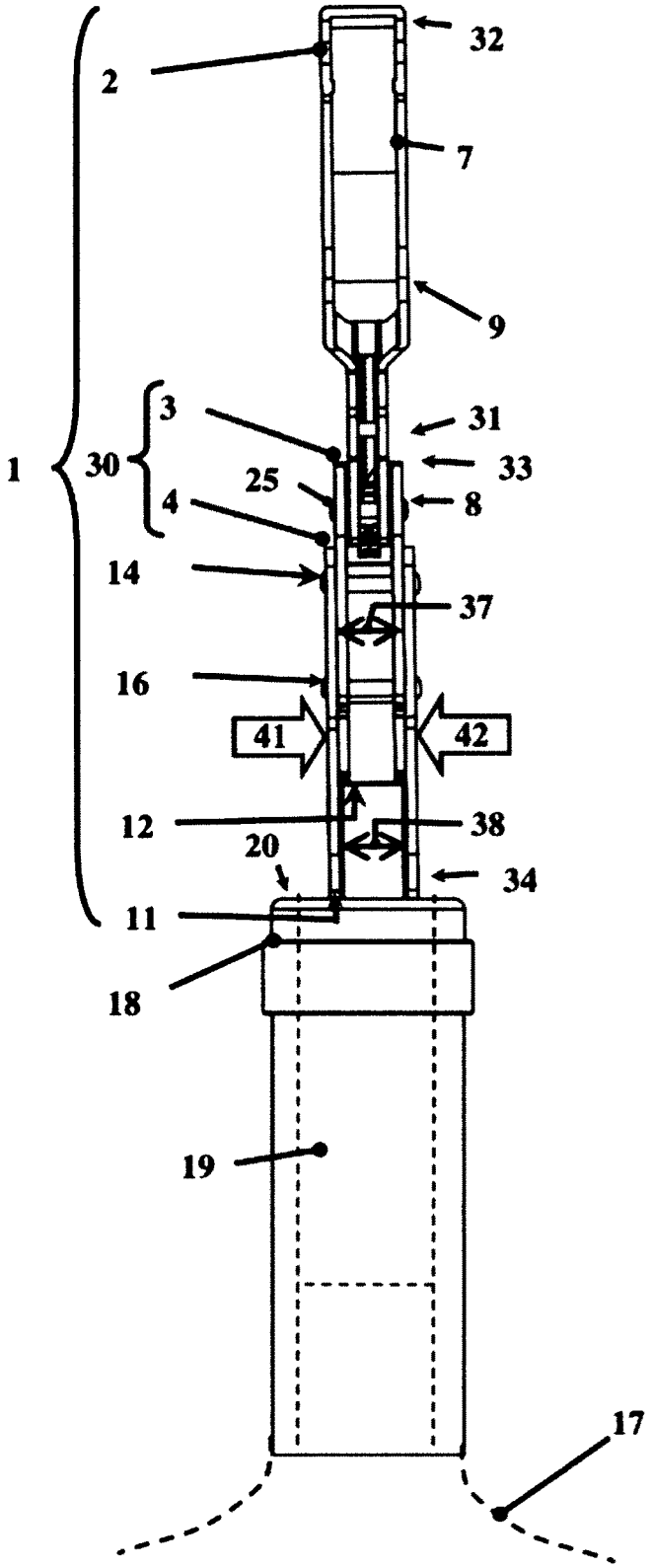
FIG. 11 represents a schematic perspective view of the corkscrew according to the invention in a position corresponding to that of FIG. 6, in which the screw or gimlet spiral has been removed to show in detail the coupling between first lever and second lever of the corkscrew.

In the embodiment shown the articulated lever (30) comprises (FIG. 1, FIG. 7, FIG. 8) a portion shaped as a crown cap opener (10). In particular the portion shaped as a crown cap opener (10) is obtained on the first lever (3) of the articulated lever (30). However, it will be evident to those skilled in the art that the crown cap opener (10) can be absent or can be positioned on the body (2) of the corkscrew (1) or in another desired position. Therefore, along the longitudinal development of the body (2), delimited by a first end (31) and by a second end (32) opposite to the first end (31), there are:

an articulated lever (30) positioned along the body in correspondence of the first end (31) of the body, the articulated lever (30) being rotatable with respect to the body (2) by hinging at a fulcrum point (8) placed near an initial end (33) of the articulated lever (30);

a handle (7) positioned along the body in correspondence of the second end (32) of the body intended to exert the extraction force by the user;

an extraction screw (5) positioned along the body in a position that is between the articulated lever (30) and the handle (7), the extraction screw (5) being rotatable with respect to the body (2) by hinging at a pivot point (9).

Figure 2:
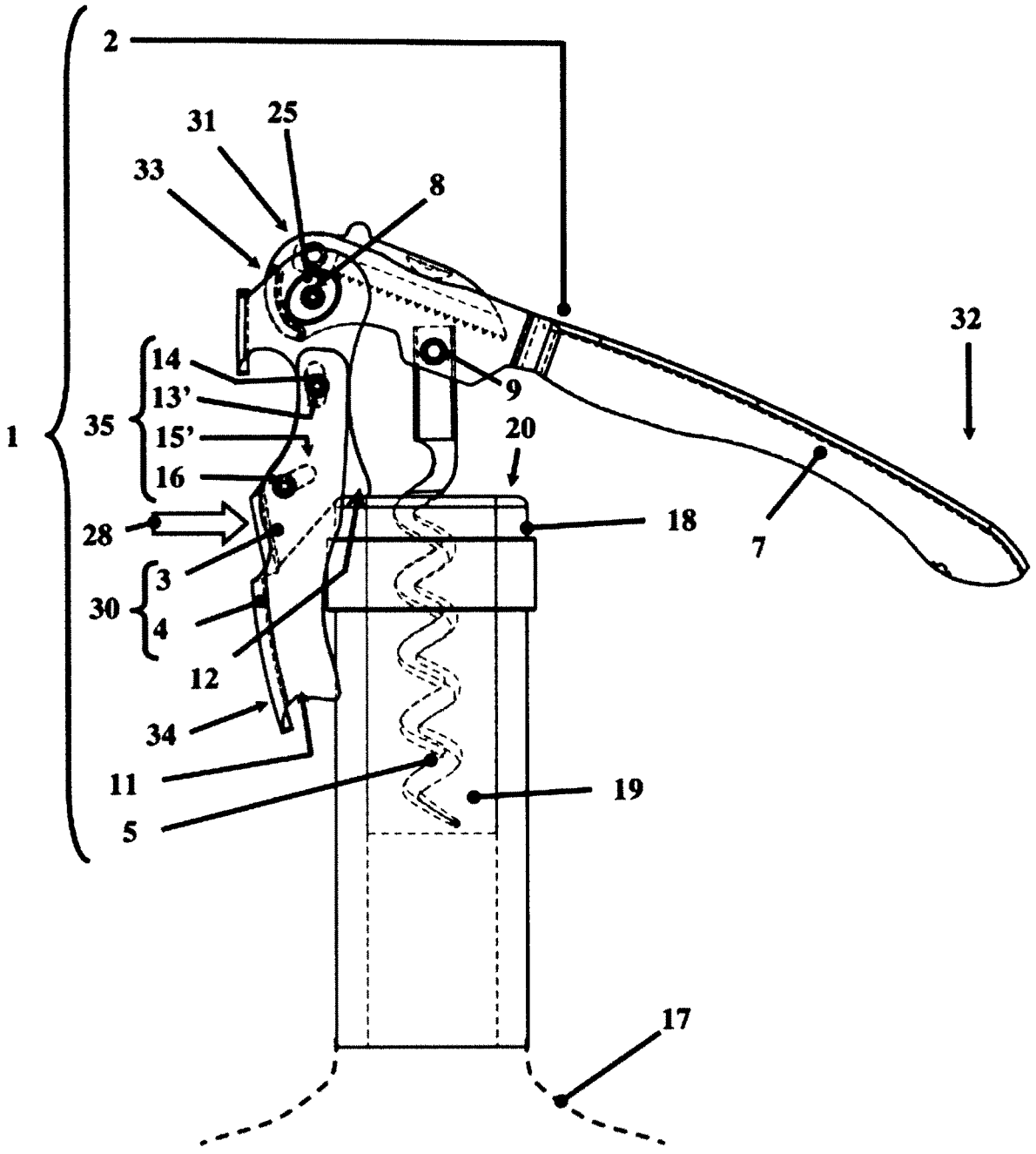
FIG. 2 represents a schematic side view of the corkscrew according to the invention in a second phase of the process of extraction of a cork from the neck of a bottle in which the first lever is taken into a stable bearing condition on the edge of the neck of the bottle.
Figure 3:
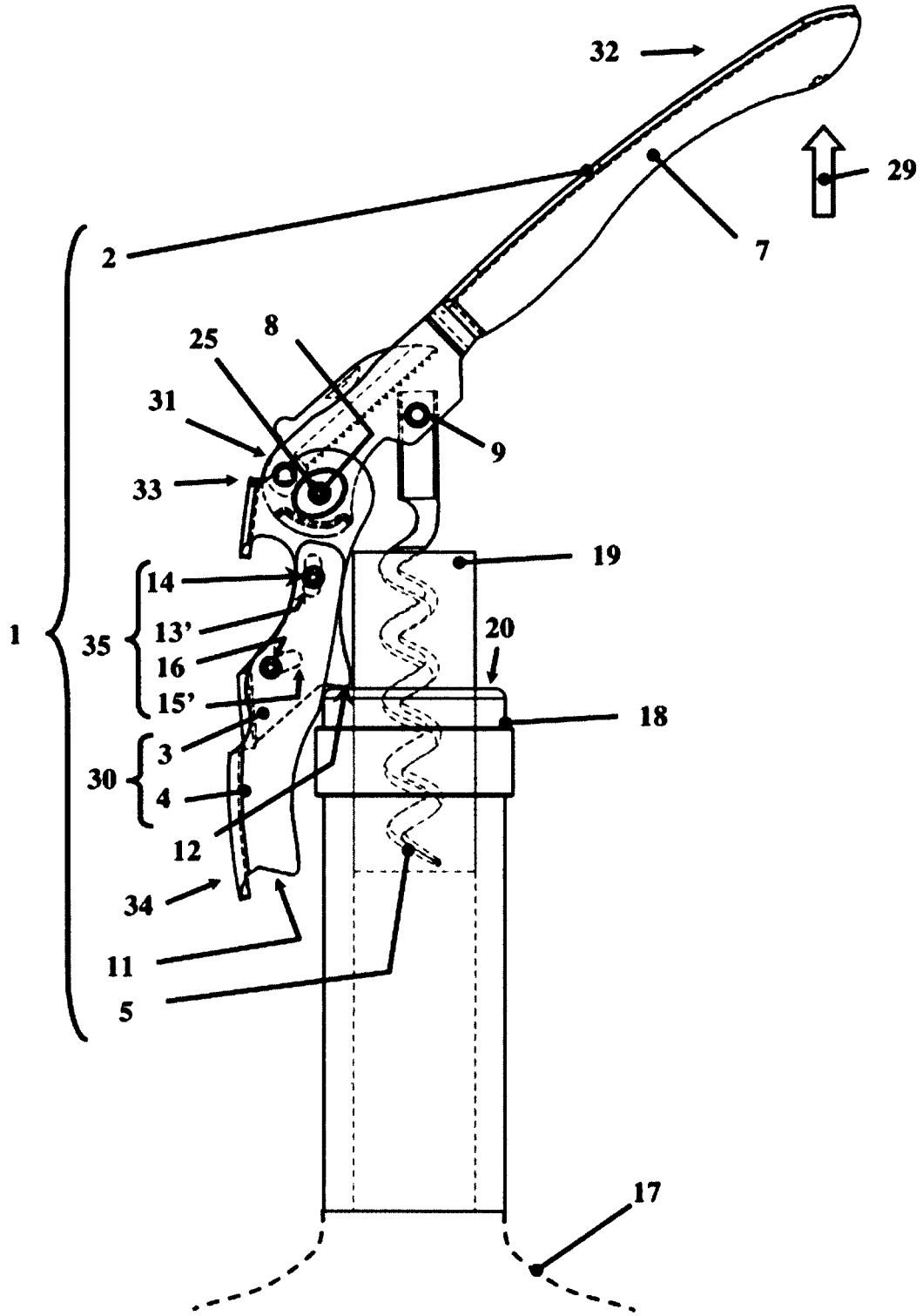
FIG. 3 represents a schematic side view of the corkscrew according to the invention in a third phase of the process of extraction of a cork from the neck of a bottle in which a force is exerted from the bottom upwards on the handle or grip to start the extraction of the cork from the neck of the bottle.
Figure 4:
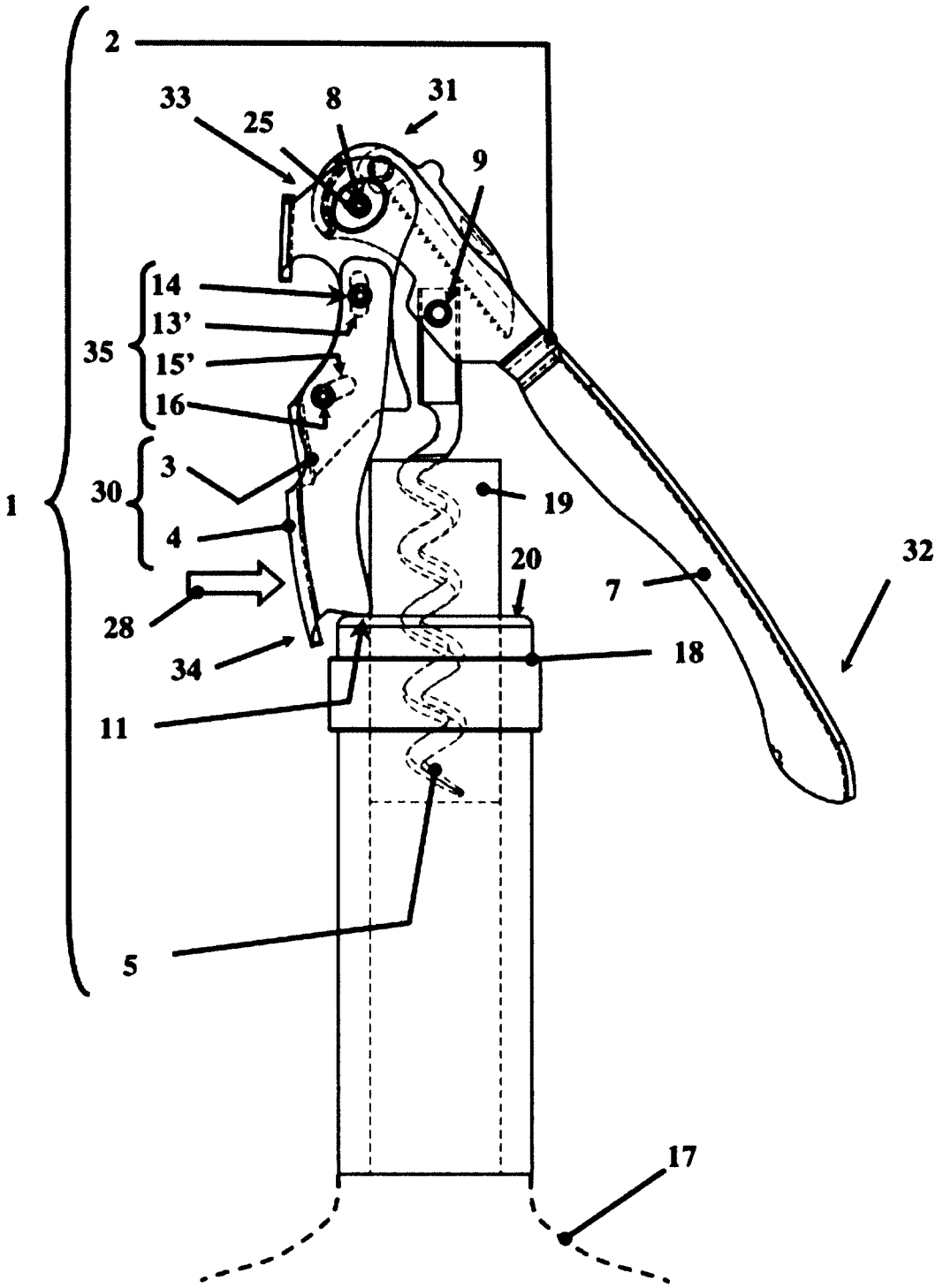
FIG. 4 represents a schematic side view of the corkscrew according to the invention in a fourth phase of the process of extraction of a cork from the neck of a bottle in which the second lever is taken into a stable bearing condition on the edge of the neck of the bottle.
Figure 5:
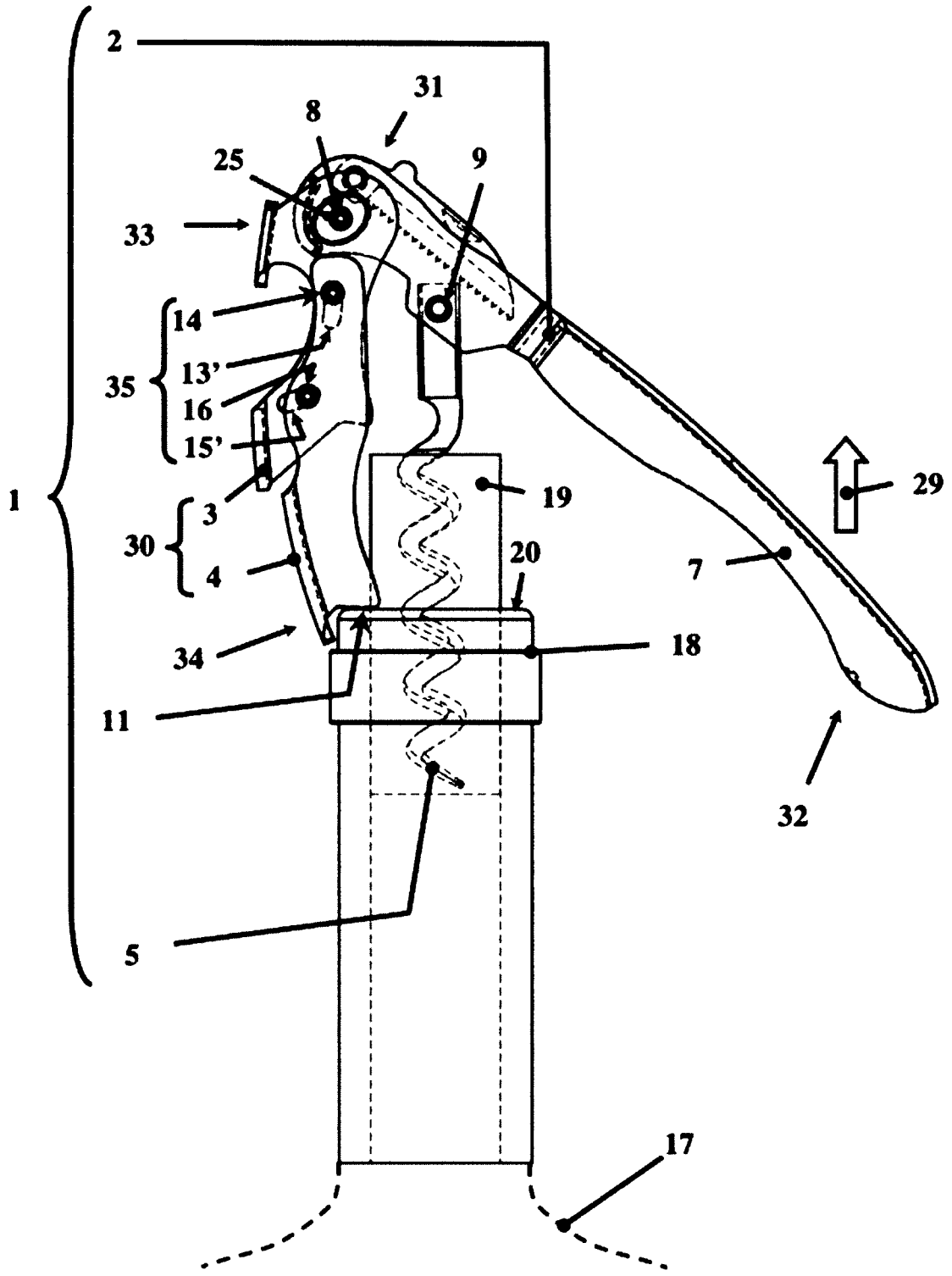
FIG. 5 represents a schematic side view of the corkscrew according to the invention in a fifth phase of the process of extraction of a cork from the neck of a bottle in which a force is exerted from the bottom upwards on the handle or grip to continue the extraction of the cork from the neck of the bottle.
Figure 6:
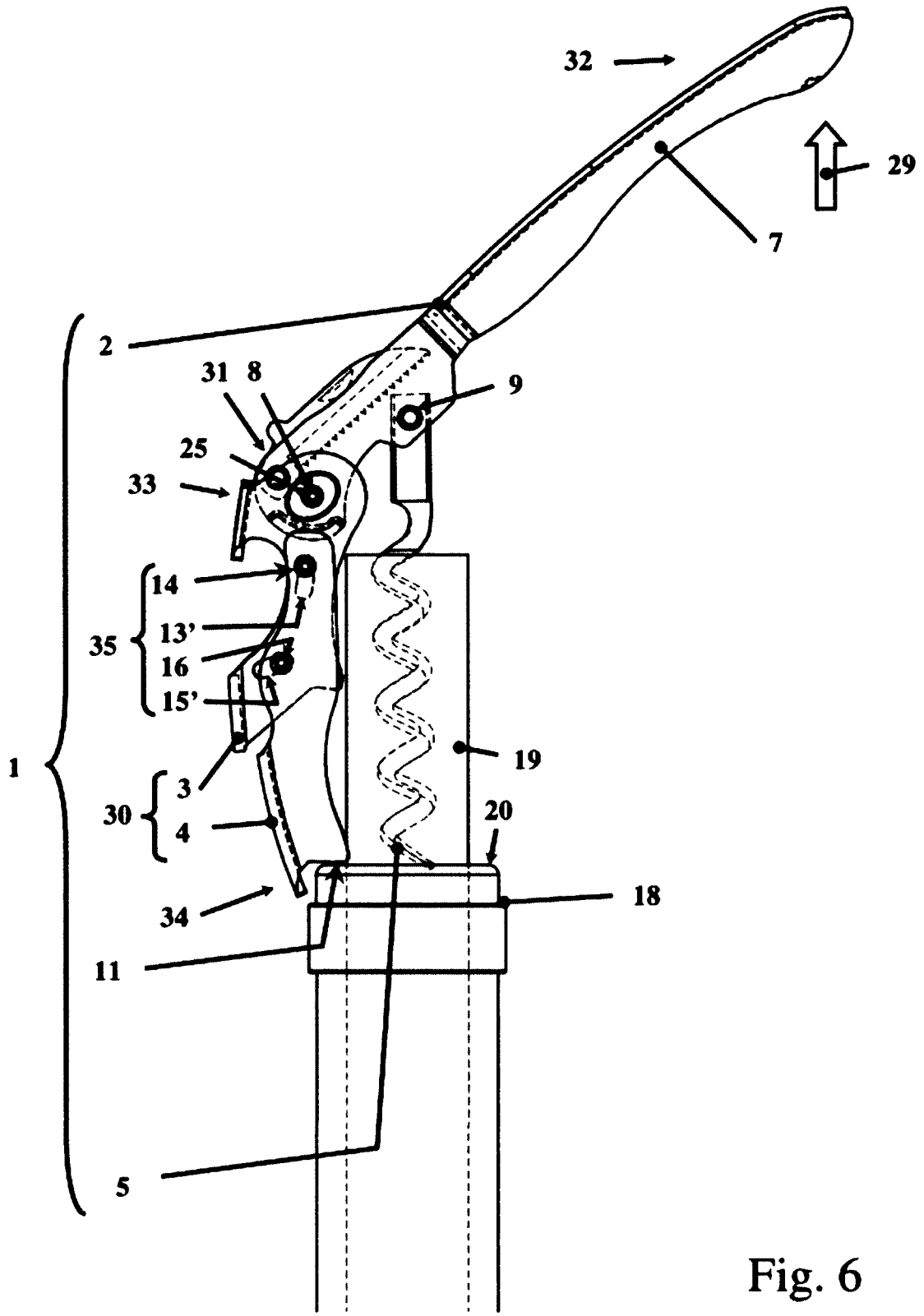
FIG. 6 represents a schematic side view of the corkscrew according to the invention in a sixth final phase of the process of extraction of a cork from the neck of a bottle in which the cork is completely extracted from the neck of the bottle.

The articulated lever (30) consists of a first lever (3) and of a second lever (4) which are arranged one after the other according to a configuration in which the first lever (3) constitutes an arm and is hinged in correspondence of the initial end (33) of the articulated lever (30) by hinging at the fulcrum point (8) in such a way that the initial end (33) of the articulated lever (30) is placed in correspondence of or near the first end (31) of the body. The second lever (4) constitutes a forearm and is fixed in a movable way on the first lever (3) in correspondence of or near a first fixing zone of the first lever (3) that is opposite to a second fixing zone of the first lever (3) that corresponds to the initial end (33) of the articulated lever (30). The fixing of the second lever (4) to the first lever (3) does not occur by means of a rotational hinging that enables the rotation of the second lever (4) with respect to the first lever (3) as in a many of the prior art solutions, but occurs according to an innovative coupling system (35) based on the cooperation between a set of slots (13', 13", 15', 15") and a set of pins (14, 16) which allow to obtain a translation movement of the second lever (4) with respect to the first lever (3) in such a way as to take the second lever (4) between:

a first position (FIG. 2, FIG. 3) of the second lever (4) or rest position in which the second lever (4) is not used during the phase of extraction of the cork (19) from the neck (18) of a bottle (17), this phase being a phase in which the first lever (3) is used, the first position of the second lever (4) being a position in which the second lever (4) is in a condition of non-interference with the first lever (3), the condition of non-interference being defined by a travel end position of the pins (14, 16) within the corresponding slots (13', 13", 15', 15");

a second position (FIG. 4, FIG. 5, FIG. 6, FIG. 8, FIG. 11) or position of use of the second lever (4) in which the second lever (4) is used during the phase of extraction of the cork (19) from the neck (18) of a bottle (17), the second position of the second lever (4) being a position in which the second lever (4) is in a bearing condition on the upper edge (20) of the neck (18) of the bottle (17) according to a configuration in which the second tooth (11) of the second lever (4) constitutes a stable coupling surface between the second lever (4) and the upper edge (20) of the neck (18) of the bottle (17).

Preferably, but not necessarily, in the second position of the second lever (4), the set of slots (13', 13", 15', 15") and the set of pins (14, 16) allows the first lever (3) to achieve a position firmly resting on the neck of the bottle, thus facilitating a more stable grip and a more efficient and safer extraction of the cork avoiding slipping.

With reference to the use of the corkscrew (1) according to the present invention, the articulated lever (30) comprising the first lever (3) and the second lever (4) allows to extract the cork (19) from the neck (18) of a bottle (17) by means of a series of phases, and namely:

(a) inserting (FIG. 1) the extraction screw (5) into the cork (19);

(b) by applying (FIG. 2) a force according to a pushing direction (28) oriented in such a way as to bring the articulated lever (30) towards the extraction screw (5) or towards the neck (18) of the bottle (17), bearing the first lever (3) on an upper edge (20) of the neck (18) of the bottle (17) according to a configuration in which a first tooth (12) of the first lever (3) constitutes a stable coupling surface between the first lever (3) and the upper edge (20) of the neck (18) of the bottle (17);

(c) by applying (FIG. 3), on the body (2) in correspondence of the second end (32) of the body or on the handle (7), a force according to the direction of application of the extraction force (29) oriented from the bottom upwards, obtaining a partial extraction of the cork (19) from the neck (18) of the bottle (17), the cork (19) being partially extracted from the neck (18) for at least one first portion of the length of the cork (19) itself;

(d) by applying (FIG. 4) a force according to a pushing direction (28) oriented in such a way as to bring the articulated lever (30) towards the extraction screw (5) or towards the neck (18) of the bottle (17), bearing the second lever (4) on the upper edge (20) of the neck (18) of the bottle (17) according to a configuration in which a second tooth (11) of the second lever (4) constitutes a stable coupling surface between the second lever (4) and the upper edge (20) of the neck (18) of the bottle (17);

(e) by applying (FIG. 5, FIG. 8), on the body (2) in correspondence of the second end (32) of the body or on the handle (7), a force according to the direction of application of the extraction force (29) oriented from the bottom upwards, obtaining an additional extraction of the cork (19) from the neck (18) of the bottle (17), the cork (19) being more extracted from the neck (18) of the bottle (17) with respect to phase (c);

(f) by continuing the application (FIG. 6), on the body (2) in correspondence of the second end (32) of the body or on the handle (7), of a force according to the direction of application of the extraction force (29) oriented from the bottom upwards, obtaining a complete extraction of the cork (19) from the neck (18) of the bottle (17), the cork (19) being completely extracted from the neck (18) of the bottle (17).

The particularity of the corkscrew (1) described consists of the type of coupling established between the first lever (3) and the second lever (4). In fact, as previously explained, the fixing of the second lever (4) to the first lever (3) occurs according to a coupling system (35) based on the cooperation between a set of slots (13', 13", 15', 15") and a set of pins (14, 16) that allow to obtain a translation movement of the second lever (4) with respect to the first lever (3) in such a way as to take the second lever (4) between the previously defined first position (FIG. 2, FIG. 3) of the second lever (4) or rest position and second position (FIG. 4, FIG. 5, FIG. 6, FIG. 8, FIG. 11) or position of use of the second lever (4).

This coupling system (35) is particularly advantageous because:

- with reference to the previously described phase (b), the coupling system (35) comprising slots (13', 13", 15', 15") and pins (14, 16) guides the stroke of the second lever (4) in such a way as to take it in a stable position of non-interference with the operation of the first lever (3), the stable position of non-interference being precisely defined by a first travel end position (FIG. 2) of the pins (14, 16) within the corresponding slots (13', 13", 15', 15");
- with reference to the previously described phase (e), the coupling system (35) comprising slots (13', 13", 15', 15") and pins (14, 16) guides the stroke of the first lever (3) in such a way as to take it in a stable position of non-interference with the operation of the second lever (4), the stable position of non-interference being precisely defined by a second travel end position (FIG. 5) of the pins (14, 16) within the corresponding slots (13', 13", 15', 15").

As a consequence, when in phases (b) and (c) the first lever (3) is in a working position firmly resting by means of the first tooth (12) on the upper edge (20) of the neck (18) of the bottle (17), the second lever (4), also thanks to the reciprocal arrangement of the slots (13', 13", 15', 15") and to their orientation, is firmly kept in the position of non-interference with the extraction movement that is imparted on the first lever (3) by acting on the body (2) of the corkscrew (1) with the application (FIG. 3) of the force according to the direction of application of the extraction force (29) oriented from the bottom upwards. When phase (c) ends, by applying a force in the direction opposite to the previously applied one to obtain the partial extraction of the cork (19), one obtains a rotation of the body (2) around the pivot point (9) of the extraction screw (5) with the consequence that (FIG. 4) the second end (32) of the body lowers itself while the first end (31) of the body rises, since the position of the pivot point (9) of the extraction screw (5) is constrained by the condition of insertion of the extraction screw (5) within the volume of the cork (19). Following the rising of the first end (31) of the body the articulated lever (30) rises as well:

- the first lever (3) itself rises (FIG. 4) reaching a final position that is located above the final end of the partially extracted cork (19) in such a way that the first tooth (12) is no longer in a bearing condition on the upper edge (20) of the neck (18) of the bottle (17);
- the second lever (4) itself rises (FIG. 4) reaching a final position such that the second tooth (11) can be taken into a bearing condition on the upper edge (20) of the neck (18) of the bottle (17).

At the end of this phase of rising of the articulated lever (30) it is important to notice that the first lever (3), which was used in the first part of the extraction phase (FIG. 3), has remained in the "working" position, being in a condition of interference with the vertical stroke of the cork (19). Thanks to the coupling system (35) the cork (19) is prevented from being stuck below the first lever (3) when the second lever (4) is used to complete the extraction of the cork (19) from the neck (18) of the bottle (17). In fact, in case of absence of the coupling system (35) it would not be possible to complete the uncorking operation easily because the cork (19) would get stuck on the first tooth (12) of the first lever (3) which in this way would prevent its complete extraction. This is a problem that may arise in the corkscrews of the prior art, in which case it is necessary to intervene manually to move the first lever from the condition of interference before being able to proceed with the extraction of the cork.

Therefore, in phase (e) one proceeds (FIG. 5, FIG. 6) with the extraction of the cork (19) by applying, on the body (2) in correspondence of the second end (32) of the body or on the handle (7), a force according to the direction of application of the extraction force (29) oriented from the bottom upwards. Immediately, said force causes the pins (14, 16), which are constrained to the second lever (4), which is longer than the first lever (3), to slide inside the corresponding slots (13', 13", 15', 15") obtained on the first lever (3). This movement, controlled and delimited by the length of the slots (13', 13", 15', 15"), causes the first lever (3) to move automatically during the second phase of extraction in a position of non-interference.

The sliding of the pins (14, 16) is a gentle movement and with no jamming thanks to the fact that the slots (13', 13", 15', 15") have a design profile generated with tangent arches and have no straight lines and interference points.

The slots (13', 13", 15', 15") form a set of slots, which comprise in their turn a set of first slots (13', 13") and a set of second slots (15', 15").

The first slots (13', 13") develop according to a curvilinear path. The choice of a curvilinear path for first the slots (13', 13") is due to the fact that with this shape, rather than linear, the sliding of the corresponding first pin is smoother. There is no jamming and consequent sudden movements due to the accumulation of moment of force.

The second slots (15', 15") develop according to a linear path there being no sliding problems due to the fact that they have a more favourable angle to enable an easy sliding of the corresponding second pin on them.

However, for the purpose of operation of the present invention it will be evident that other embodiments can also be provided in which:

- the first slots (13', 13") develop according to a linear path and the second slots (15', 15") develop according to a curvilinear path;
- the first slots (13', 13") develop according to a linear path and the second slots (15', 15") develop according to a linear path;
- the first slots (13', 13") develop according to a curvilinear path and the second slots (15', 15") develop according to a curvilinear path.

The preferred solution of the present invention is that according to which the first slots (13', 13") develop according to a curvilinear path and the second slots (15', 15") develop according to a linear path.

Figure 12:
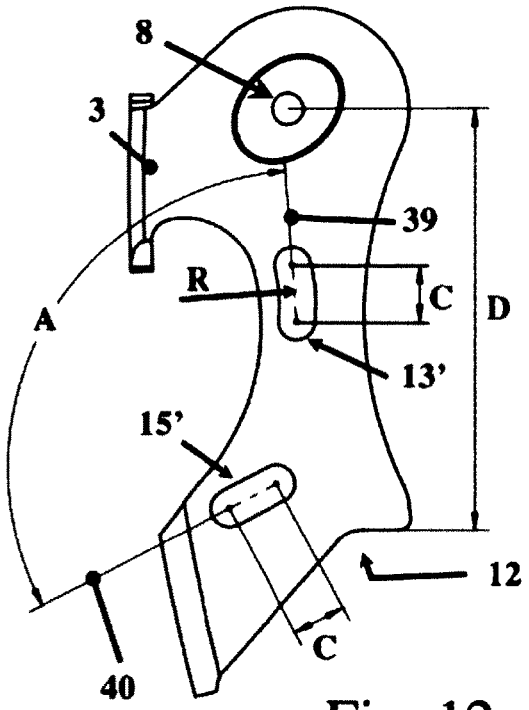
FIG. 12 is a side view of the first lever of the corkscrew according to the invention.
Figure 13:
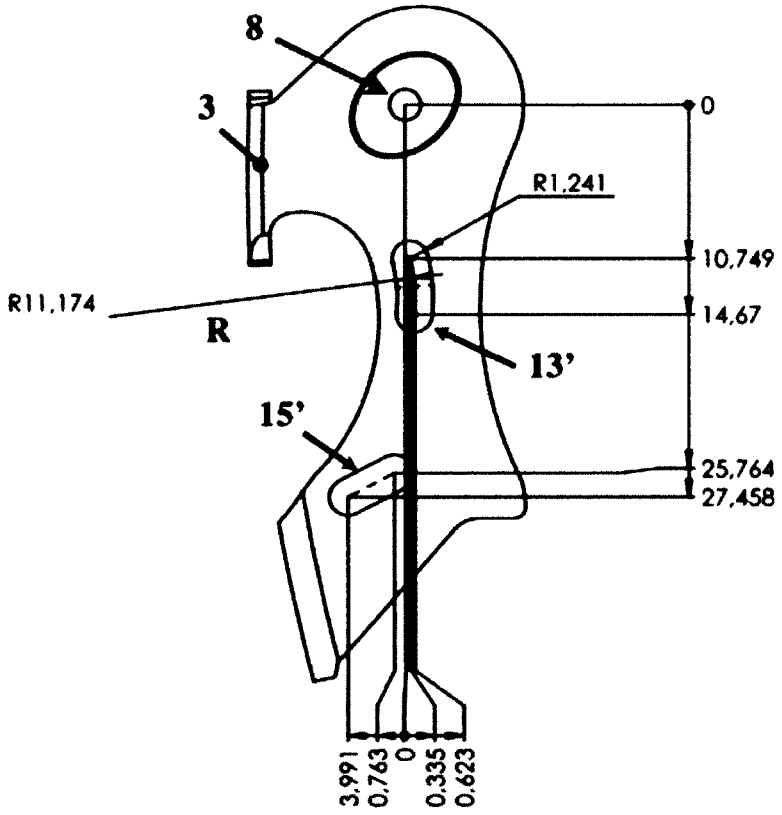
FIG. 13 is a side view of the first lever of the corkscrew according to the invention, which shows measures in millimetres of a particular first alternative embodiment.
Figure 14:
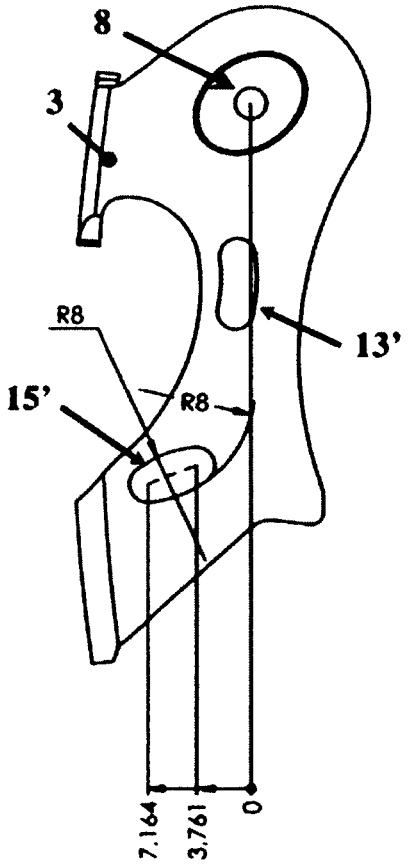
FIG. 14 is a side view of the first lever of the corkscrew according to the invention, which shows measures in millimetres of a particular second alternative embodiment.

Preferably the development path having a curvilinear shape has (FIG. 12, FIG. 13, FIG. 14) a bending radius (R) between 9 and 14 mm.

On the contrary, the first slots (13', 13") have an almost vertical development and, therefore, in the case of the first slots, a rounded shape of the wall provides better results in terms of movement smoothness as compared to a slot having a rectilinear path. By almost vertical development referring to the first slots (13', 13") it is meant that the reciprocally aligned first slots (13', 13") develop according to a development path which is essentially parallel with respect to the direction of longitudinal development of the first lever (3) in such a way that, in the usual condition of use with the first lever (3) arranged vertically, the first slots (13', 13") have a development corresponding to the vertical direction according to which the first lever (3) is arranged.

In order to obtain the advantageous characteristics described, the first slots (13', 13") and the second slots (15', 15") are reciprocally arranged (FIG. 12, FIG. 13, FIG. 14) according to an arrangement in which the angle (A) between a first axis (39) of longitudinal development of the first slots (13', 13") and a second axis (40) of longitudinal development of the second slots (15', 15") is between 95° and 130°. In the preferred solution of the present invention the angle (A) is between 100° and 120°.

The stroke (C) defined by the longitudinal development of the first slots (13', 13") or of the second slots (15', 15") is between 2.5 mm and 6 mm, preferably it is between 3 and 4 mm. For example the stroke (C) defined by the longitudinal development of the first slots (13', 13") or of the second slots (15', 15") can have a value of 3.6 mm.

The distance (D) between the fulcrum point (8) and the first tooth (12) of the first lever (3) can be between 25 and 35 mm, preferably between 28 and 30 mm. For example the distance (D) between the fulcrum point (8) and the first tooth (12) of the first lever (3) can be of 29 mm.

For example in a particular first alternative embodiment (FIG. 13) it can be provided that the curvilinear development path of the first slots (13', 13") has a bending radius (R) of about 11 mm. The first slots (13', 13") have the respective rounded ends with a bending radius of about 1.2 mm and the corner rounding centres of the ends are positioned at a reciprocal distance of about 3.9 mm. The second slots (15', 15") have the respective rounded ends with a bending radius of about 1.2 mm and the corner rounding centres of the ends are positioned at a reciprocal distance of about 3.6 mm.

For example in a particular second alternative embodiment (FIG. 14) it can be provided that the second slots (15', 15") have a configuration of the sliding sides with an opposed double radius in which the second slots (15', 15") have a reciprocal distance between the opposite sliding sides which is greater in correspondence of a central zone of the slot with respect to the terminal end zones of the slot.

The use of the system with an articulated lever (30) consisting of two levers (3, 4) causes the cork (19), which can have a length up to 48-50 mm, in the stroke due to the uncorking operation, to maintain a vertical trajectory without the application of tangent forces that might cause the cork to break and the contamination of the wine or even the re-start of the operation to recover the remaining stump due to the breaking of the cork (19) inside the neck (18) of the bottle (17).

In particular, in the embodiment shown, the first lever (3) has (FIG. 8, FIG. 10) an essentially "U"-shaped section in which the end sides of the "U" shape form the first flank (21) and the second flank (22), which are essentially parallel flanks, on each of which there is obtained a corresponding portion of the first propping tooth (12) for the engagement with the neck (18) of the bottle (17) in such a way that a first portion of the first tooth (12) on the first flank (21) of the first lever (3) is aligned and parallel to a second portion of the first tooth (12) on the second flank (22) of the first lever (3).

On the flanks (21, 22) a first pair of slots comprising two first slots (13', 13") and a second pair of slots comprising two second slots (15', 15") are also obtained. The slots of each pair are arranged according to a configuration in which the slots of each pair are reciprocally aligned to each other according to a side view (FIG. 9) of the first lever (3).

In particular (FIG. 10) on the first flank (21) of the first lever (3) there is a first slot (13') of the first flank and on the second flank (22) of the first lever (3) there is a first slot (13") of the second flank. The first slot (13') of the first flank and the first slot (13") of the second flank are reciprocally aligned according to a side view (FIG. 9) of the first lever (3), constituting the first pair of slots.

In particular (FIG. 10) on the first flank (21) of the first lever (3) there is a second slot (15') of the first flank and on the second flank (22) of the first lever (3) there is a second slot (15") of the second flank. The second slot (15') of the first flank and the second slot (15") of the second flank are reciprocally aligned according to a side view (FIG. 9) of the first lever (3), constituting the second pair of slots.

In particular, in the embodiment shown, the second lever (4) has (FIG. 8, FIG. 10) an essentially "U"-shaped section in which the end sides of the "U" shape form the essentially parallel first wall (23) and second wall (24) which internally define a groove (36) between them (FIG. 10), which consists of the internal portion delimited by the "U" shape. On each of the walls (23, 24) a corresponding portion of the second propping tooth (11) is obtained for the engagement with the neck (18) of the bottle (17) in such a way that a first portion of the second tooth (11) on the first wall (23) of the second lever (4) is aligned and parallel to a second portion of the second tooth (11) on the second wall (24) of the second lever (4). Since the second lever (4) is fixed by means of the coupling system (35) after the first lever (3), the second tooth (11) of the second lever (4) is in correspondence of the final end (34) of the articulated lever (30), wherein the final end (34) of the articulated lever (30) is the opposite end of the articulated lever (30) with respect to the previously defined initial end (33) which is rotatably fixed to the body (2) by hinging at the fulcrum point (8).

On the walls (23, 24) a first pair of holes comprising two first holes (26', 26") and a second pair of holes comprising two second holes (27', 27") are also obtained. The holes of each pair are arranged according to a configuration in which the holes of each pair are reciprocally aligned to each other according to a side view (FIG. 9) of the first lever (3).

In particular (FIG. 10) on the first wall (23) of the second lever (4) there is a first hole (26') of the first wall and on the second wall (24) of the second lever (4) there is a first hole (26") of the second wall. The first hole (26') of the first wall and the first hole (26") of the second wall are reciprocally aligned according to a side view (FIG. 9) of the second lever (4), constituting the first pair of holes.

In particular (FIG. 10) on the first wall (23) of the second lever (4) there is a second hole (27') of the first wall and on the second wall (24) of the second lever (4) there is a second hole (27") of the second wall. The second hole (27') of the first wall and the second hole (27") of the second wall are reciprocally aligned according to a side view (FIG. 9) of the second lever (4), constituting the second pair of holes.

The "U" shape of the first lever (3) has (FIG. 11) a first width (37) measured externally with respect to the "U"-shaped configuration. The first width (37) of the first lever (3) is smaller than the second width (38) of the second lever (4) measured internally with respect to the "U"-shaped configuration. The two widths (37, 38) are almost identical but with such a tolerance that it is possible to house the first lever (3) within the groove (36) consisting of the internal portion delimited by the "U" shape of the second lever (4). In other words, the essentially parallel first wall (23) and second wall (24) of the "U" shape of the second lever (4) internally define a groove (36) between them, which consists of the internal portion delimited by the "U" shape of the second lever (4), the "U" shape of the first lever (3) having a first width (37), measured externally with respect to the "U"-shaped configuration of the first lever (3), in which the first width (37) is smaller than a second width (38) of the second lever (4), measured internally with respect to the "U"-shaped configuration of the second lever (4), the first lever (3) being housed within the groove (36) consisting of the internal portion delimited by the "U" shape of the second lever (4).

It will be evident that in alternative solutions, which will be readily apparent to those skilled in the art, one can also provide arrangements in which the "U" shape of the second lever (4) has a width that is smaller than the second width (38) of the first lever (3) in such a way that it is the second lever (4) to be housed within a housing consisting of the internal portion delimited by the "U" shape of the first lever (3). In other words, the essentially parallel first flank (21) and second flank (22) of the "U" shape of the first lever (3) internally define a housing between them, which consists of the internal portion delimited by the "U" shape of the first lever (3), the "U" shape of the second lever (4) having a first extension, measured externally with respect to the "U"-shaped configuration of the second lever (4), wherein the first extension is smaller than a second extension of the first lever (3), measured internally with respect to the "U"-shaped configuration of the first lever (3), the second lever (4) being housed within the housing consisting of the internal portion delimited by the "U" shape of the first lever (3).

A first pin (14) constitutes a first element of reciprocal constraint between the first lever (3) and the second lever (4) according to a configuration in which the first pin (14) crosses:

- the first hole (26') of the first wall (23) of the second lever (4);
- the first slot (13') of the first flank (21) of the first lever (3);
- the remaining gap of the groove (36);
- the first slot (13") of the second flank (22) of the first lever (3);
- the first hole (26") of the second wall (24) of the second lever (4).

A second pin (16) constitutes a second element of reciprocal constraint between the first lever (3) and the second lever (4) according to a configuration in which the second pin (16) crosses:

- the second hole (27') of the first wall (23) of the second lever (4);
- the second slot (15') of the first flank (21) of the first lever (3);
- the remaining gap of the groove (36);
- the second slot (15") of the second flank (22) of the first lever (3);
- the second hole (27") of the second wall (24) of the second lever (4).

The coupling system (35) between the first lever (3) and the second lever (4) is thus made up of the set of first pin (14), first slots (13', 13") of the first lever (3), first holes (26', 26") of the second lever (4), second pin (16), second slots (15', 15") of the first lever (3), second holes (27', 27") of the second lever (4).

A third pin (15) enables a rotatable fixing of the articulated lever (30) to the body (2) of the corkscrew (1) in correspondence of the first end (31) of the body (2).

To conclude, the present invention relates (FIG. 1, FIG. 2, FIG. 3, FIG. 4, FIG. 5, FIG. 6, FIG. 7, FIG. 8) to a corkscrew (1) for the extraction of a cork (19) from the neck (18) of a bottle (17), the corkscrew (1) comprising:

- a body (2) provided with a first end (31) and with a second end (32);
- an extraction screw (5) hinged at a pivot point (9) which is placed between the first end (31) and the second end (32), the extraction screw (5) being suitable for insertion by screwing within the volume of the cork (19);
- an articulated lever (30) hinged at a fulcrum point (8) placed in correspondence of or near the first end (31), the articulated lever (30) comprising a first lever (3) and a second lever (4) coupled with each other by a coupling system (35) wherein the coupling system (35) is configured to enable a reciprocal movement of the second lever (4) with respect to the first lever (3), the articulated lever (30) being provided with a first propping tooth (12) arranged on the first lever (3) and with a second propping tooth (11) arranged on the second lever (4), the first and the second tooth (11, 12) being suitable for propping the corkscrew (1) on the neck (12) of the bottle (17).

The coupling system (35) between the first lever (3) and the second lever (4) comprises (FIG. 9, FIG. 10) at least one set of slots (13', 13", 15', 15"), a set of pins (14, 16) and a set of holes (26', 26", 27', 27"), wherein the pins (14, 16) pass at least through the holes (26', 26", 27', 27") and the slots (13', 13", 15', 15") fixing the first lever (3) and the second lever (4) to each other in such a way that the second lever (4) is a prolongation of the first lever (3), the pins (14, 16) being slidably engaged in respective slots (13', 13", 15', 15") in such a way that the reciprocal movement of the second lever (4) with respect to the first lever (3) is a movement that occurs in a guided condition by means of the pins (14, 16), the reciprocal movement of the second lever (4) with respect to the first lever (3) being constrained by sliding paths, which are defined by the sets of slots (13', 13", 15', 15") within which the respective pins (14, 16) are slidable.

The at least one set of slots (13', 13", 15', 15") preferably comprises (FIG. 7, FIG. 8, FIG. 11) at least one set of first slots (13', 13") consisting of a first slot (13') of a first side (41) of the corkscrew (1) and of a first slot (13") of a second side (42) of the corkscrew (1) which is an opposite side with respect to the first side (41). The first slot (13') of the first side (41) and the first slot (13") of the second side (42) are arranged according to a configuration of reciprocal alignment of one slot with respect to the other according to (FIG. 9) a side view of the corkscrew (1). The set of pins (14, 16) comprises at least one first pin (14) which is slidably engaged in the first slots (13', 13") according to a configuration in which the first pin (14) crosses the first slot (13') of the first side (41) and the first slot (13") of the second side (42) which are reciprocally aligned and guide the sliding of the first pin (14) along the respective sliding path.

Even more preferably the at least one set of slots (13', 13", 15', 15") comprises (FIG. 7, FIG. 8, FIG. 11) at least one set of second slots (15', 15") consisting of a second slot (15') of the first side (41) of the corkscrew (1) and of a second slot (15") of the second side (42) of the corkscrew (1) which is the opposite side with respect to the first side (41), the second slot (15') of the first side (41) and the second slot (15") of the second side (42) being arranged according to a configuration of reciprocal alignment of one slot with respect to the other according to (FIG. 9) a side view of the corkscrew (1). The set of pins (14, 16) comprises at least one second pin (16) which is slidably engaged in the second slots (15', 15") according to a configuration in which the second pin (16) crosses the second slot (15') of the first side (41) and the second slot (15") of the second side (42) which are reciprocally aligned and guide the sliding of the second pin (16) along the respective sliding path.

The cork can be made of any suitable material, which is normally used, such as silicone or cork.

The description of the present invention has been made with reference to the enclosed figures in a preferred embodiment, but it is evident that many possible changes, modifications and variations will be immediately clear to those skilled in the art in the light of the previous description. Thus, it must be underlined that the invention is not limited to the previous description, but it includes all the changes, modifications and variations in accordance with the appended claims.

NOMENCLATURE USED

With reference to the identification numbers in the enclosed figures, the following nomenclature has been used:

1. Corkscrew
2. Body
3. First lever
4. Second lever
5. Extraction screw
6. Blade or cutting means
7. Handle or grip
8. Fulcrum or fulcrum point
9. Pivot or pivot point
10. Crown cap opener
11. Second tooth
12. First tooth
13'. First slot of the first flank or of the first side
13". First slot of the second flank or of the second side
14. First pin
15'. Second slot of the first flank or of the first side
15". Second slot of the second flank or of the second side
16. Second pin
17. Bottle
18. Neck
19. Cork
20. Edge
21. First flank of the first lever
22. Second flank of the first lever
23. First wall of the second lever
24. Second wall of the second lever
25. Third pin
26'. First hole of the first wall
26". First hole of the second wall
27'. Second hole of the first wall
27". Second hole of the second wall
28. Pushing direction
29. Direction of application of the extraction force
30. Articulated lever
31. First end of the body
32. Second end of the body
33. Initial end of the articulated lever
34. Final end of the articulated lever
35. Coupling system
36. Groove
37. First width
38. Second width
39. First axis
40. Second axis
41. First side
42. Second side
A. Angle
C. Stroke
D. Distance
R. Bending radius

The invention claimed is:

1. A corkscrew for the extraction of a cork from a neck of a bottle, the corkscrew comprising a body provided with a first end and with a second end, an extraction screw hinged at a pivot point which is placed between the first end and the second end, the extraction screw being suitable for insertion by screwing within the volume of the cork, an articulated lever hinged at a fulcrum point near the first end, the articulated lever comprising a first lever and a second lever coupled with each other by a coupling system wherein the coupling system is configured to enable a reciprocal movement of the second lever with respect to the first lever, the articulated lever being provided with a first propping tooth placed on the first lever and with a second propping tooth placed on the second lever, the first and the second tooth being suitable for propping the corkscrew on the neck of the bottle characterized in that the coupling system between the first lever and the second lever comprises at least two sets of slots, at least one set of pins, and at least one set of holes, wherein the pins pass at least through the holes and the slots fixing the first lever and the second lever to each other in such a way that the second lever is a prolongation of the first lever, the pins being slidably engaged in respective slots in such a way that the reciprocal movement of the second lever with respect to the first lever is a movement that occurs in a guided condition by means of the pins, the reciprocal movement of the second lever with respect to the first lever being constrained by sliding paths which are defined by the set of slots within which the respective pins are slidable and wherein the two sets of slots extend in different directions on the first lever.

2. The corkscrew for the extraction of a cork from the neck of a bottle according to claim 1, characterized in that said at least two sets of slots comprises at least one set of first slots comprising a first slot of a first side of the corkscrew and of a first slot of a second side of the corkscrew which is an opposite side with respect to the first side, the first slot of the first side and the first slot of the second side being arranged according to a reciprocally aligned configuration of one slot with respect to the other according to a side view of the corkscrew, said set of pins comprising at least one first pin which is slidably engaged in the at least one set of first slots according to a configuration in which the first pin crosses the first slot of the first side and the first slot of the second side which are reciprocally aligned and guide the sliding of the first pin along the respective sliding path.

3. The corkscrew for the extraction of a cork from the neck of a bottle according to claim 2, characterized in that said at least two sets of slots comprises at least one set of second slots comprising a second slot of the first side of the corkscrew and of a second slot of the second side of the corkscrew which is the opposite side with respect to the first side, the second slot of the first side and the second slot of the second side being arranged according to a reciprocally aligned configuration of one slot with respect to the other according a side view of the corkscrew, said set of pins comprising at least one second pin which is slidably engaged in the at least one set of second slots according to a configuration in which the second pin crosses the second slot of the first side and the second slot of the second side which are reciprocally aligned and guide the sliding of the second pin along the respective sliding path.

4. The corkscrew for the extraction of a cork from the neck of a bottle according to claim 3, characterized in that the at least one set of first slots and the at least one set of second slots are reciprocally arranged according to an arrangement in which an angle (A) between a first axis of longitudinal development of the at least one set of first slots and a second axis of longitudinal development of the at least one set of second slots is between 95 degree and 130 degree.

5. The corkscrew for the extraction of a cork from the neck of a bottle according to claim 4, characterized in that the angle (A) is between 100 degree and 120 degree.

6. The corkscrew for the extraction of a cork from the neck of a bottle according to claim 2, characterized in that the longitudinal development of the at least one set of first slots defines a stroke (C) of the first pin wherein the stroke (C) of the first pin is between 2.5 mm and 6 mm.

7. The corkscrew for the extraction of a cork from the neck of a bottle according to claim 6, characterized in that the stroke (C) of the first pin is between 3 and 4 mm.

8. The corkscrew for the extraction of a cork from the neck of a bottle according to claim 7, characterized in that the stroke (C) of the first pin is of approximately 3.6 mm.

9. The corkscrew for the extraction of a cork from the neck of a bottle according to claim 3, characterized in that the longitudinal development of the at least one set of second slots defines a stroke (C) of the second pin wherein the stroke (C) of the second pin is between 2.5 mm and 6 mm.

10. The corkscrew for the extraction of a cork from the neck of a bottle according to claim 9, characterized in that the stroke of the second pin is between 3 and 4 mm.

11. The corkscrew for the extraction of a cork from the neck of a bottle according to claim 10, characterized in that the stroke (C) of the second pin is of approximately 3.6 mm.

12. The corkscrew for the extraction of a cork from the neck of a bottle according to claim 3, characterized in that the at least one set of first slots develop according to a development path having a curvilinear shape and the at least one set of second slots develop according to a development path having a linear shape.

13. The corkscrew for the extraction of a cork from the neck of a bottle according to claim 3, characterized in that the at least one set of first slots develop according to a development path having a curvilinear shape and the at least one set of second slots develop according to a development path having a curvilinear shape.

14. The corkscrew for the extraction of a cork from the neck of a bottle according to claim 3, characterized in that the at least one set of first slots develop according to a development path having a linear shape and the at least one set of second slots develop according to a development path having a curvilinear shape.

15. The corkscrew for the extraction of a cork from the neck of a bottle according to claim 3, characterized in that the at least one set of first slots develop according to a development path having a linear shape and the at least one set of second slots develop according to a development path having a linear shape.

16. The corkscrew for the extraction of a cork from the neck of a bottle according to claim 12, characterized in that said development path having the curvilinear shape has a bending radius (R) between 9 and 14 mm.

17. The corkscrew for the extraction of a cork from the neck of a bottle according to claim 2 characterized in that the at least one set of first slots develop according to a development path which is essentially parallel with respect to the direction of longitudinal development of the first lever.

18. The corkscrew for the extraction of a cork from the neck of a bottle according to claim 1, characterized in that the fulcrum point and the first tooth of the first lever are placed at a reciprocal distance (D) between 25 and 35 mm.

19. The corkscrew for the extraction of a cork from the neck of a bottle according to claim 18, characterized in that the distance (D) between the fulcrum point and the first tooth of the first lever is between 28 and 30 mm.

20. The corkscrew for the extraction of a cork from the neck of a bottle according to claim 3 characterized in that the at least one set of second slots have a configuration of the sliding sides with an opposed double bending radius wherein the at least one set of second slots have a reciprocal distance between the opposite sliding sides which is greater in correspondence of a central zone of the slot with respect to terminal end zones of the slot.

21. The corkscrew for the extraction of a cork from the neck of a bottle according to claim 1, characterized in that said two sets of slots and said set of pins allow to obtain a translation movement of the second lever with respect to the first lever in such a way as to take the second lever between: a first position of the second lever or rest position in which the second lever is not used during the phase of extraction of the cork from the neck of the bottle, this phase being a phase in which the first lever is used, the first position of the second lever being a position in which the second lever is in a condition of noninterference with the first lever, the condition of non-interference being defined by a travel end position of the pins within the corresponding slots; a second position or position of use of the second lever in which the second lever is used during the phase of extraction of the cork from the neck of the bottle, the second position of the second lever being a position in which the second lever is in a bearing condition on the upper edge of the neck of the bottle according to a configuration in which the second tooth of the second lever constitutes a stable coupling surface between the second lever and the upper edge of the neck of the bottle.

22. The corkscrew for the extraction of a cork from the neck of a bottle according to claim 2, characterized in that the first lever has an essentially "U"-shaped section in which end sides of the "U" shape form a first flank and a second flank which are essentially parallel flanks, on each of the flanks there being obtained a corresponding portion of the first propping tooth for the engagement with the neck of the bottle in such a way that a first portion of the first tooth on the first flank of the first lever is aligned and parallel to a second portion of the first tooth on the second flank of the first lever.

23. The corkscrew for the extraction of a cork from the neck of a bottle according to claim 22 characterized in that on the first flank of the first lever there is the first slot of the first side and on the second flank of the first lever there is the first slot of the second side.

24. The corkscrew for the extraction of a cork from the neck of a bottle according to claim 22 characterized in that said at least two sets of slots comprises at least one set of second slots comprising a second slot of the first side of the corkscrew and of a second slot of the second side of the corkscrew which is the opposite side with respect to the first side, the second slot of the first side and the second slot of the second side being arranged according to a reciprocally aligned configuration of one slot with respect to the other according a side view of the corkscrew, said set of pins comprising at least one second pin which is slidably engaged in the at least one set of second slots according to a configuration in which the second pin crosses the second slot of the first side and the second slot of the second side which are reciprocally aligned and guide the sliding of the second pin along the respective sliding path, and wherein on the first flank of the first lever there is the second slot of the first side and on the second flank of the first lever there is the second slot of the second side.

25. The corkscrew for the extraction of a cork from the neck of a bottle according to claim 22, characterized in that the second lever has an essentially "U"-shaped section in which end sides of the "U" shape form a first wall and a second wall which are essentially parallel walls, on each wall there being obtained a corresponding portion of the second propping tooth for the engagement with the neck of the bottle in such a way that a first portion of the second tooth on the first wall of the second lever is aligned and parallel to a second portion of the second tooth on the second wall of the second lever.

26. The corkscrew for the extraction of a cork from the neck of a bottle according to claim 25 characterized in that on the first wall of the second lever there is a first hole of the first wall and on the second wall of the second lever there is a first hole of the second wall, the first hole of the first wall and the first hole of the second wall being reciprocally aligned according to a side view of the second lever, constituting a first pair of holes intended for the passage of the first pin which is slidably engaged in the first slots.

27. The corkscrew for the extraction of a cork from the neck of a bottle according to claim 25, characterized in that said at least two sets of slots comprises at least one set of second slots comprising a second slot of the first side of the corkscrew and of a second slot of the second side of the corkscrew which is the opposite side with respect to the first side, the second slot of the first side and the second slot of the second side being arranged according to a reciprocally aligned configuration of one slot with respect to the other according a side view of the corkscrew, said set of pins comprising at least one second pin which is slidably engaged in the second slots according to a configuration in which the second pin crosses the second slot of the first side and the second slot of the second side which are reciprocally aligned and guide the sliding of the second pin along the respective sliding path, and wherein on the first wall of the second lever there is a second hole of the first wall and on the second wall of the second lever there is a second hole of the second wall, the second hole of the first wall and the second hole of the second wall being reciprocally aligned according to a side view of the second lever, constituting a second pair of holes intended for the passage of the second pin which is slidably engaged in the at least one set of second slots.

28. The corkscrew for the extraction of a cork from the neck of a bottle according to claim 25 characterized in that the essentially parallel first wall and second wall of the "U" shape of the second lever internally define a groove between them, which consists of the internal portion delimited by the "U" shape, the "U" shape of the first lever having a first width, measured externally with respect to the "U"-shaped configuration of the first lever, wherein the first width is smaller than a second width of the second lever, measured internally with respect to the "U"-shaped configuration of the second lever, the first lever being housed within the groove comprising the internal portion delimited by the "U" shape of the second lever.

29. The corkscrew for the extraction of a cork from the neck of a bottle according to claim 25 characterized in that the essentially parallel first side and second side of the "U" shape of the first lever internally define a housing between them, which comprises the internal portion delimited by the "U" shape of the first lever, the "U" shape of the second lever having a first extension, measured externally with respect to the "U"-shaped configuration of the second lever, wherein the first extension is smaller than a second extension of the first lever, measured internally with respect to the "U"-shaped configuration, the second lever being housed within the housing consisting of the internal portion delimited by the "U" shape of the first lever.

30. The corkscrew for the extraction of a cork from the neck of a bottle according to claim 1, characterized in that the body comprises a blade or cutting means for the removal of the covering capsule or coating of the neck of the bottle.

31. The corkscrew for the extraction of a cork from the neck of a bottle according to claim 1, characterized in that the articulated lever comprises a portion shaped as a crown cap opener.

* * * * *